US008388085B2

(12) United States Patent
Linn

(10) Patent No.: US 8,388,085 B2
(45) Date of Patent: Mar. 5, 2013

(54) PRECURSOR PULSE GENERATION FOR INKJET PRINTHEAD

(75) Inventor: Scott A. Linn, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 126 days.

(21) Appl. No.: 13/119,448

(22) PCT Filed: Oct. 22, 2008

(86) PCT No.: PCT/US2008/080839

§ 371 (c)(1), (2), (4) Date: Mar. 17, 2011

(87) PCT Pub. No.: WO2010/047704

PCT Pub. Date: Apr. 29, 2010

(65) Prior Publication Data

US 2011/0169885 A1 Jul. 14, 2011

(51) Int. Cl.
*B41J 29/38* (2006.01)

(52) U.S. Cl. ..... 347/9; 347/10; 347/11; 347/60

(58) Field of Classification Search ..... 347/9–11, 347/56–60
See application file for complete search history.

(56) References Cited

U.S. PATENT DOCUMENTS

| | | | | |
|---|---|---|---|---|
| 4,490,728 | A | 12/1984 | Vaught et al. | |
| 6,318,845 | B1 * | 11/2001 | Mizutani | 347/57 |
| 6,669,317 | B2 | 12/2003 | Linder et al. | |
| 6,698,862 | B1 | 3/2004 | Choi et al. | |

FOREIGN PATENT DOCUMENTS

| | | |
|---|---|---|
| EP | 1029675 | 8/2000 |
| JP | 2000203025 | 7/2000 |
| KR | 2040011373 | 2/2004 |

* cited by examiner

*Primary Examiner* — Juanita D Jackson

(57) ABSTRACT

The present invention is embodied in a printing system (100) that includes a printhead (102) having a controller (510) configured to initiate at least one precursor pulse, send the at least one precursor pulse to a first nozzle (560), remove the at least one precursor pulse from the first nozzle for a predetermined period of time to create a pause, initiate at least one firing pulse after the pause and send the at least one firing pulse to the first nozzle (560) for ejecting an ink drop.

7 Claims, 5 Drawing Sheets

PRECURSOR PULSE GENERATION FOR INKJET PRINTHEAD

BACKGROUND

In one type of inkjet printing system, printheads receive fire signals containing fire pulses from the electronic controller. In one arrangement, the fire signal is fed directly to the nozzles in the printhead. In another arrangement, the fire signal is latched in the printhead, and the latched version of the fire signal is fed to the nozzles to control the ejection of ink drops from the nozzles.

In either of the above two arrangements, the electronic controller of the printer maintains control of all timing related to the fire signal. The timing related to the fire signal primarily refers to the actual width of the fire pulse and the point in time at which the fire pulse occurs. The electronic controller controlling the timing related to the fire signal works well for printheads capable of printing only a single column at a time, because such printheads only need one fire signal to the printhead to control the ejection of ink drops from the printhead.

However, one of the problems encountered by printheads is the number of connections to the printer controller. These connections can at times be intermittent, and the more connections the less reliable the system. In addition, the cost of the flex interconnect is higher. Finally, ink ingress can cause shorts between signals.

DETAILED DESCRIPTION OF PREFERRED EMBODIMENT

In the following description, reference is made to the accompanying drawings, which form a part hereof, and in which is shown by way of illustration a specific example in which the invention may be practiced. In this regard, directional terminology, such as "top," "bottom," "front," "back," "leading," "trailing," etc., is used with reference to the orientation of the Figure(s) being described. It is to be understood that other embodiments may be utilized and structural changes may be made without departing from the scope of the present invention.

Figure 1:
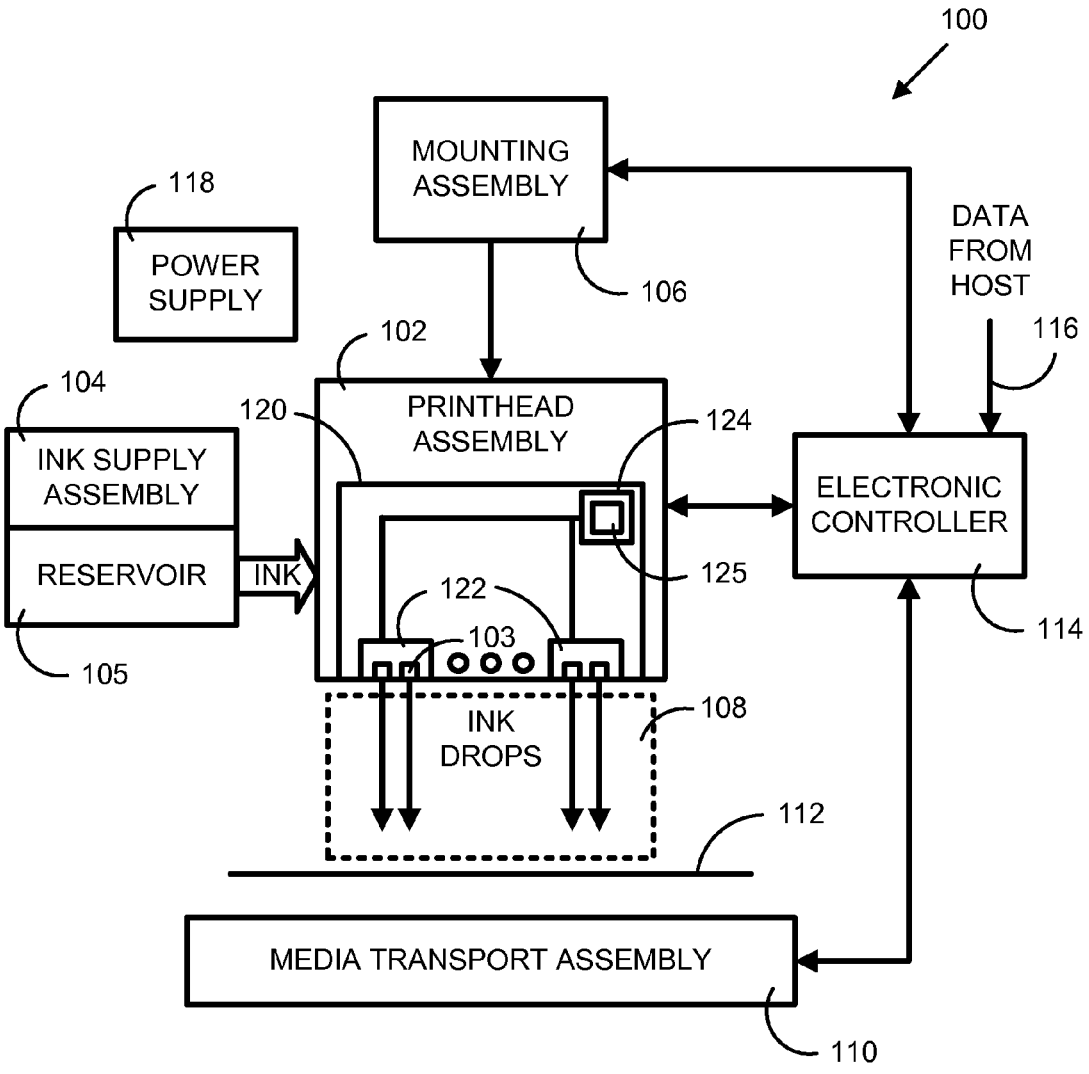
FIG. 1 is a block diagram illustrating one embodiment of an inkjet printing system according to the present invention.

FIG. 1 illustrates one embodiment of an inkjet printing system 100 according to the present invention. Inkjet printing system 100 includes an inkjet printhead assembly 102, an ink supply assembly 104, a mounting assembly 106, a media transport assembly 110, and an electronic controller 114. At least one power supply 118 provides power to the various electrical components of inkjet printing system 100. Inkjet printhead assembly 102 includes at least one printhead or printhead die 122 which ejects drops of ink through a plurality of orifices or nozzles 103 and toward a print medium 112 so as to print onto print medium 112. Print medium 112 is any type of suitable sheet material, such as paper, card stock, transparencies, Mylar, and the like. Typically, nozzles 103 are arranged in one or more columns or arrays such that properly sequenced ejection of ink from nozzles 103 causes characters, symbols, and/or other graphics or images to be printed upon print medium 112 as inkjet printhead assembly 102 and print medium 112 are moved relative to each other.

Ink supply assembly 104 supplies ink to printhead assembly 102 and includes a reservoir 105 for storing ink. As such, ink flows from reservoir 105 to inkjet printhead assembly 102. Ink supply assembly 104 and inkjet printhead assembly 102 can form either a one-way ink delivery system or a recirculating ink delivery system. In a one-way ink delivery system, substantially all of the ink supplied to inkjet printhead assembly 102 is consumed during printing. In a recirculating ink delivery system, however, only a portion of the ink supplied to printhead assembly 102 is consumed during printing. As such, ink not consumed during printing is returned to ink supply assembly 104.

In one embodiment, inkjet printhead assembly 102 and ink supply assembly 104 are housed together in an inkjet cartridge or pen. In another embodiment, ink supply assembly 104 is separate from inkjet printhead assembly 102 and supplies ink to inkjet printhead assembly 102 through an interface connection, such as a supply tube. In either embodiment, reservoir 105 of ink supply assembly 104 may be removed, replaced, and/or refilled. In one embodiment, where inkjet printhead assembly 102 and ink supply assembly 104 are housed together in an inkjet cartridge, reservoir 105 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 106 positions inkjet printhead assembly 102 relative to media transport assembly 110 and media transport assembly 110 positions print medium 112 relative to inkjet printhead assembly 102. Thus, a print zone 108 is defined adjacent to nozzles 103 in an area between inkjet printhead assembly 102 and print medium 112. In one embodiment, inkjet printhead assembly 102 is a scanning type printhead assembly. As such, mounting assembly 106 includes a carriage for moving inkjet printhead assembly 102 relative to media transport assembly 110 to scan print medium 112. In another embodiment, inkjet printhead assembly 102 is a non-scanning type printhead assembly. As such, mounting assembly 106 fixes inkjet printhead assembly 102 at a prescribed position relative to media transport assembly 110. Thus, media transport assembly 110 positions print medium 112 relative to inkjet printhead assembly 102.

Electronic controller or printer controller 114 typically includes a processor, firmware, and other printer electronics for communicating with and controlling inkjet printhead assembly 102, mounting assembly 106, and media transport assembly 110. Electronic controller 114 receives data 116 from a host system, such as a computer, and includes memory for temporarily storing data 116. Typically, data 116 is sent to inkjet printing system 100 along an electronic, infrared, optical, or other information transfer path. Data 116 represents, for example, a document and/or file to be printed. As such, data 116 forms a print job for inkjet printing system 100 and includes one or more print job commands and/or command parameters.

In one embodiment, inkjet printhead assembly 102 is a wide-array or multi-head printhead assembly. In one embodiment, inkjet printhead assembly 102 includes a carrier 120, which carries printhead 122 and module manager IC 124. In one embodiment carrier 120 provides electrical communication between printhead dies 122, module manager IC 124, and electronic controller 114, and fluidic communication between printhead 122 and ink supply assembly 104.

Printhead assembly 102 can include any suitable number (N) of printheads 122, where N is at least one. Before a print operation can be performed, data must be sent to printhead 122. Data includes, for example, print data and non-print data for printhead 122. Print data includes, for example, nozzle data containing pixel information, such as bitmap print data. Non-print data includes, for example, command/status (CS) data, clock data, and/or synchronization data. Status data of CS data includes, for example, printhead temperature or position, printhead resolution, and/or error notification.

In one embodiment, logic and drive circuitry are incorporated in a module manager integrated circuit (IC) 124 located on inkjet printhead assembly 102. Electronic controller 114 and module manager IC 124 operate together to control inkjet printhead assembly 102 for ejection of ink drops from nozzles 103. As such, electronic controller 114 and module manager IC 124 define a pattern of ejected ink drops which form characters, symbols, and/or other graphics or images on print medium 112. The pattern of ejected ink drops is determined by the print job commands and/or command parameters.

In one embodiment, the on-chip fire pulse generator 125 uses an initiation event to start firing, so the pulse width of the first signal is not critical to energy delivery. In this case, an on-chip fire pulse generator 125 is used and pre-programmed to deliver a single external pulse to generate multiple pulse lanes inside the printhead 102 and also multiple pulses for each lane, as precursor pulses to start the fire sequence. In general, the precursor pulse can include plural pulses to eject ink out of the nozzle to improve thermal efficiency and/or dot quality. The on-chip fire pulse generator 125 with the precursor pulses can extend the life of the module manager integrated circuit (IC) 124 and can be used with older, single fire pulse inkjet printheads.

For example, a firmware change can be performed with the same controller chip to generate more complex fire signaling in the form of precursor pulses for the newer printheads. In addition, different programmed pulse widths can be used for various nozzle options on the printhead. This can extend the life of the module manager integrated circuit (IC) 124. In addition, when using a precursor pulse, an external fire pad can be eliminated. In other words, the precursor pulses add flexibility due to the ability to generate multiple fire pulses on-chip without adding extra pads to the inkjet printhead interface.

Figure 2:
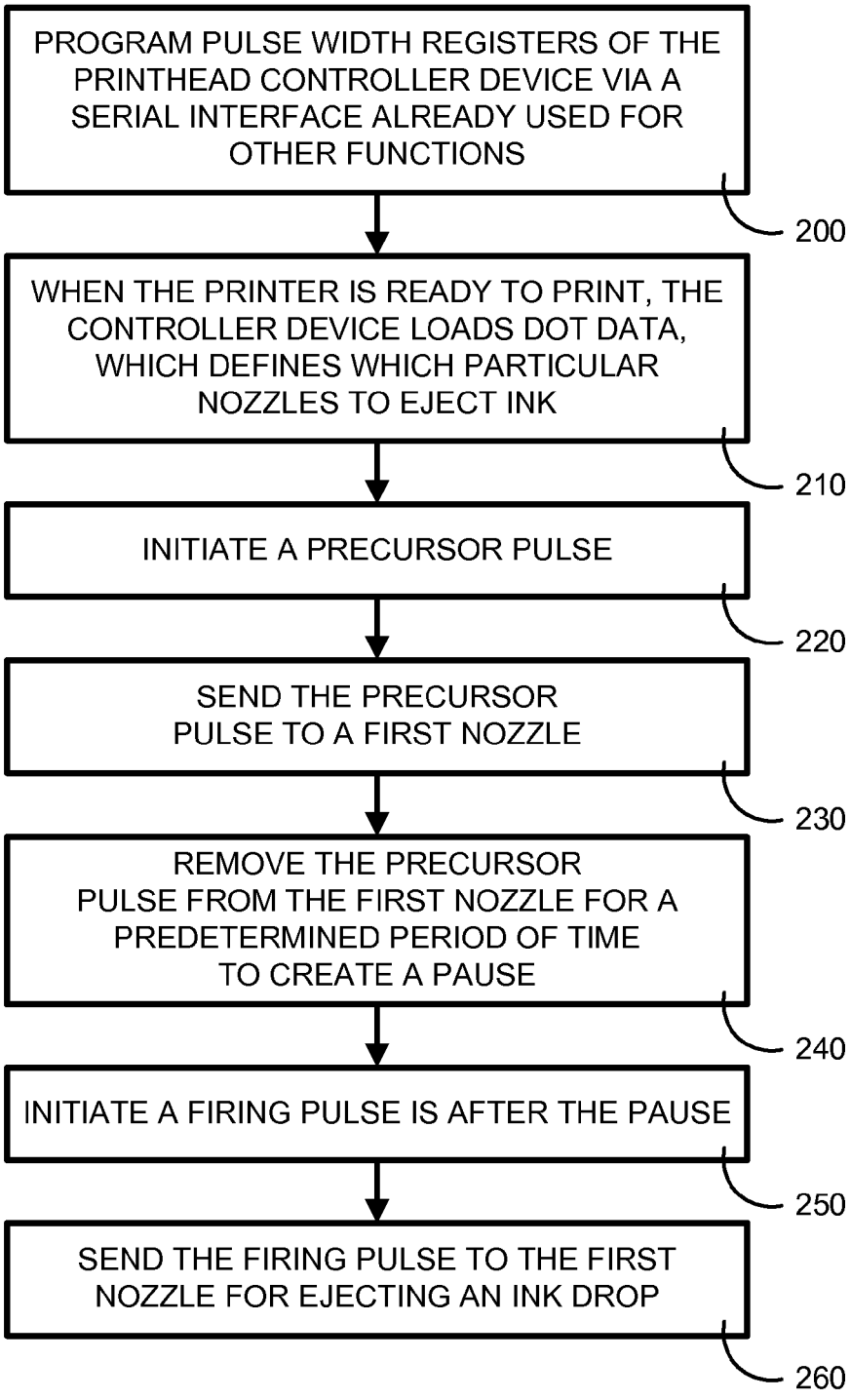
FIG. 2 is a flow diagram illustrating one embodiment of an inkjet printing system according to the present invention.

FIG. 2 is a flow diagram illustrating one embodiment of an inkjet printing system according to the present invention. Referring to FIG. 1 along with FIG. 2, in general, first, the printhead controller 114 programs precursor and firing pulses into pulse width registers of the on-chip fire pulse generator 125 of the module manager integrated circuit (IC) 124 via a serial interface already used for other functions (step 200). Second, when the printhead assembly 102 is ready to print, the controller 114 loads dot data in the columns representing the nozzles 103 for defining which particular nozzles are to eject ink (step 210). Third, the controller 114 initiates a precursor pulse (step 220) and then sends the precursor pulse to a first nozzle (step 230).

The precursor pulse is then removed from the first nozzle for a predetermined period of time to create a pause (step 240). In one embodiment, the precursor pulse is removed by using and initiating a dead time register that creates the pause (described in detail below). Last, a firing pulse is then initiated after the pause (step 250) and then the firing pulse is sent to the first nozzle for ejecting an ink drop (step 260). In one embodiment, the firing pulses can be short to long pulses, to start the internal fire pulse generation circuits.

In one embodiment, the on-chip fire pulse generator 125 of the module manager integrated circuit (IC) 124 includes separate wire lines for sending the precursor and fire pulses to nozzle 103. In this case, the precursor pulse can be sent either internally or externally (externally supplied precursor) with respect to the printhead die.

In another embodiment, a single external wire line is used to send the precursor and fire pulses to nozzle 103. In this case, the precursor pulses allow fire pulse generation at a reduced system cost because multiple fire signals can be generated from the single external fire wire line, thereby saving connections.

In one embodiment with larger printheads (four to six ink colors), there is extra area available due to mechanical constraints, and this area can be used as free digital design space to enable digital fire pulse generation for no additional silicon area cost. Eliminating extra pads is very important, especially for systems where multiple printheads are utilized because the cost savings multiply.

Figure 3:
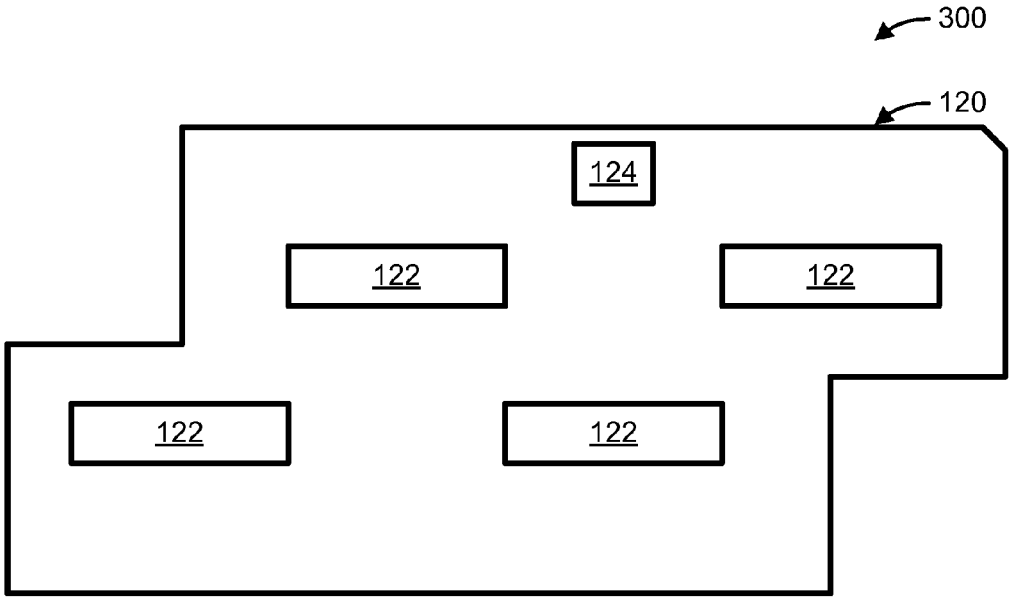
FIG. 3 is a diagram of one embodiment of an inkjet printhead sub-assembly or module according to the present invention.

FIG. 3 is a diagram of one embodiment of an inkjet printhead sub-assembly or module according to the present invention. In one embodiment, printhead dies 122 are spaced apart and staggered such that printhead dies 122 in one row overlap at least one printhead die 122 in another row. Thus, inkjet printhead assembly 102 may span a nominal page width or a width shorter or longer than nominal page width. In one embodiment, a plurality of inkjet printhead sub-assemblies or modules 300 form one inkjet printhead assembly 102.

The inkjet printhead modules 300 are substantially similar to the above described printhead assembly 102 and each have a carrier 120 which carries a plurality of printhead dies 122 and a module manager IC 124. In one embodiment, the printhead assembly 102 is formed of multiple inkjet printhead modules 102 which are mounted in an end-to-end manner and each carrier 120 has a staggered or stair-step profile. As a result, at least one printhead die 122 of one inkjet printhead module 102 overlaps at least one printhead die 122 of an adjacent inkjet printhead module 102.

Figure 4:
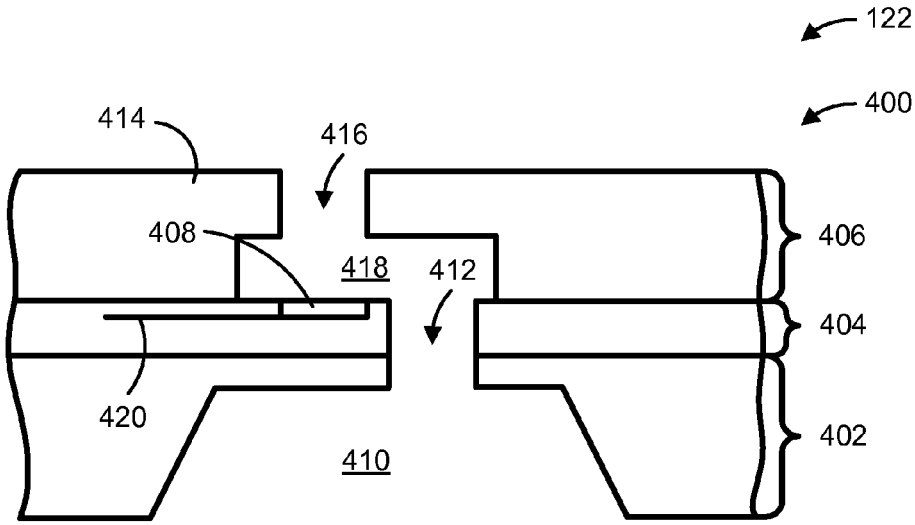
FIG. 4 is an enlarged schematic cross-sectional view illustrating portions of a one embodiment of a printhead die in the printing system of FIG. 1.

A portion of one embodiment of a printhead die 122 is illustrated schematically in FIG. 4. Printhead die 122 includes an array of printing or drop ejecting elements 400. Printing elements 400 are formed on a substrate 402 which has an ink feed slot 410 formed therein. As such, ink feed slot 410 provides a supply of liquid ink to printing elements 400. Each printing element 400 includes a thin-film structure 404, an orifice layer 406, and a firing resistor 408. Thin-film structure 404 has an ink feed channel 412 formed therein which communicates with ink feed slot 410 of substrate 402. Orifice layer 406 has a front face 414 and a nozzle opening 416 formed in front face 414. Orifice layer 406 also has a nozzle chamber 418 formed therein which communicates with nozzle opening 416 and ink feed channel 412 of thin-film structure 404. Firing resistor 408 is positioned within nozzle chamber 418 and includes leads 420 which electrically couple firing resistor 408 to a drive signal and ground.

During printing, ink flows from ink feed slot 410 to nozzle chamber 418 via ink feed channel 412. Nozzle opening 416 is operatively associated with firing resistor 408 such that droplets of ink within nozzle chamber 418 are ejected through nozzle opening 416 (e.g., normal to the plane of firing resistor 408) and toward a print medium upon energization of firing resistor 408. In one embodiment, at least one printhead 122 is implemented as a printhead having the capability of printing multiple columns of the same color or multiple columns of different colors simultaneously.

Example embodiments of printhead 122 include a thermal printhead, a piezoelectric printhead, a flex-tensional printhead, or any other type of inkjet ejection device known in the art. In one embodiment, printhead dies 122 are fully integrated thermal inkjet printheads. As such, substrate 402 is formed, for example, of silicon, glass, or a stable polymer and thin-film structure 404 is formed by one or more passivation or insulation layers of silicon dioxide, silicon carbide, silicon nitride, tantalum, poly-silicon glass, or other suitable material. Thin-film structure 404 also includes a conductive layer which defines firing resistor 408 and leads 420. The conductive layer is formed, for example, by aluminum, gold, tantalum, tantalum-aluminum, or other metal or metal alloy.

Figure 5:
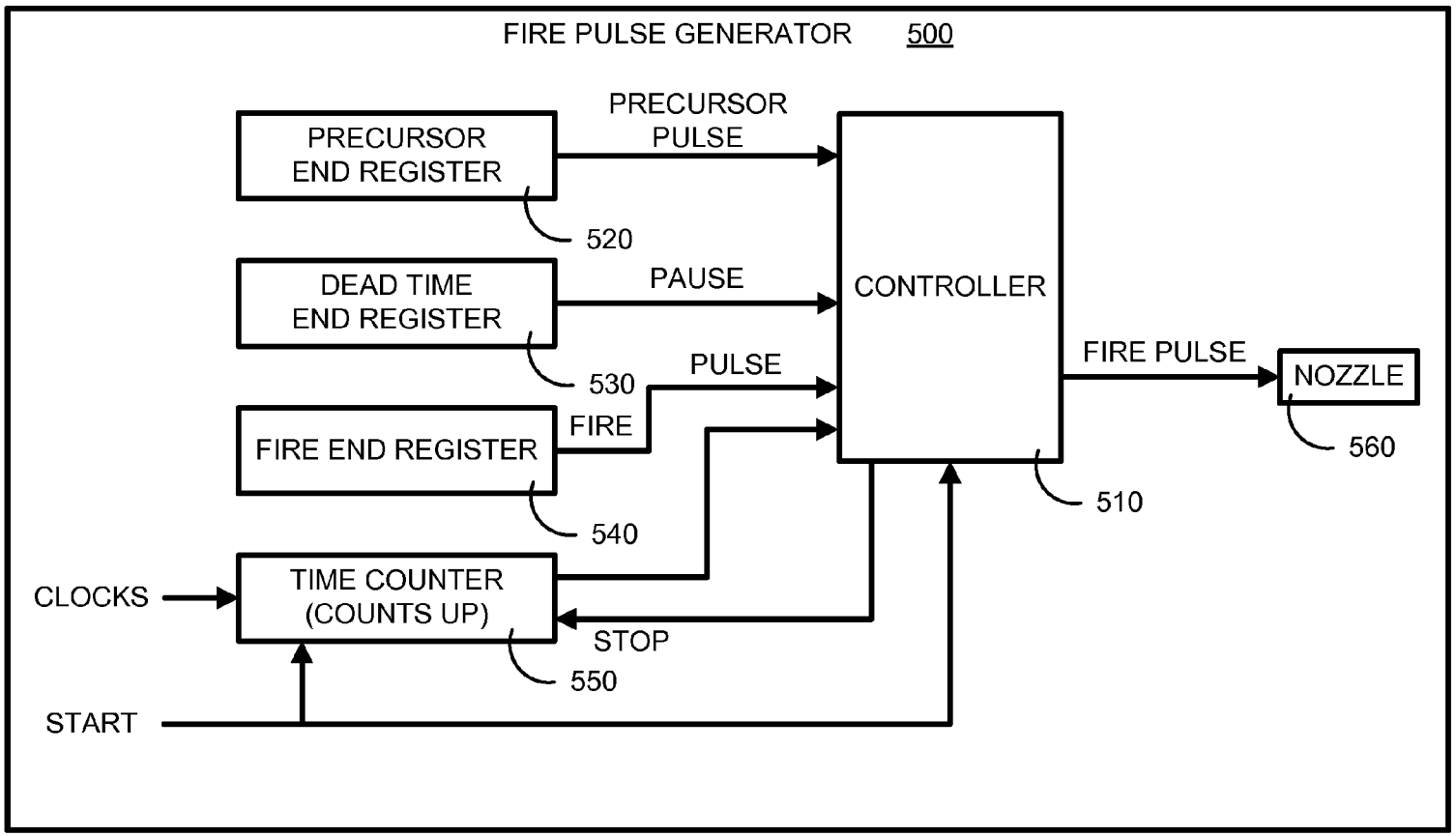
FIG. 5 is a block diagram illustrating a portion of an inkjet printhead having a fire pulse generator according to one embodiment of the present invention.

FIG. 5 is a block diagram illustrating a portion of an inkjet printhead having a fire pulse generator according to one embodiment of the present invention. Fire pulse generator 500, which is similar to fire generator 125 of FIG. 1, includes controller 510, precursor end register 520, dead time register 520, fire end register 540, time counter 550 and nozzle 560, which is similar to nozzle 103 of FIG. 1. The precursor end register 520 sends precursor pulses to the controller 510 and the fire end register 540 send fire pulses to the controller 510, while the dead time end register sends pauses to the controller 510 and a clock with the time counter 550 sends timing signals to the controller 510. The controller uses the timing signals to send a final complex fire pulse to the nozzle at predetermined times, which includes precursor pulses, fire pulses and pauses to efficiently control nozzle 560 firing.

Figure 6:
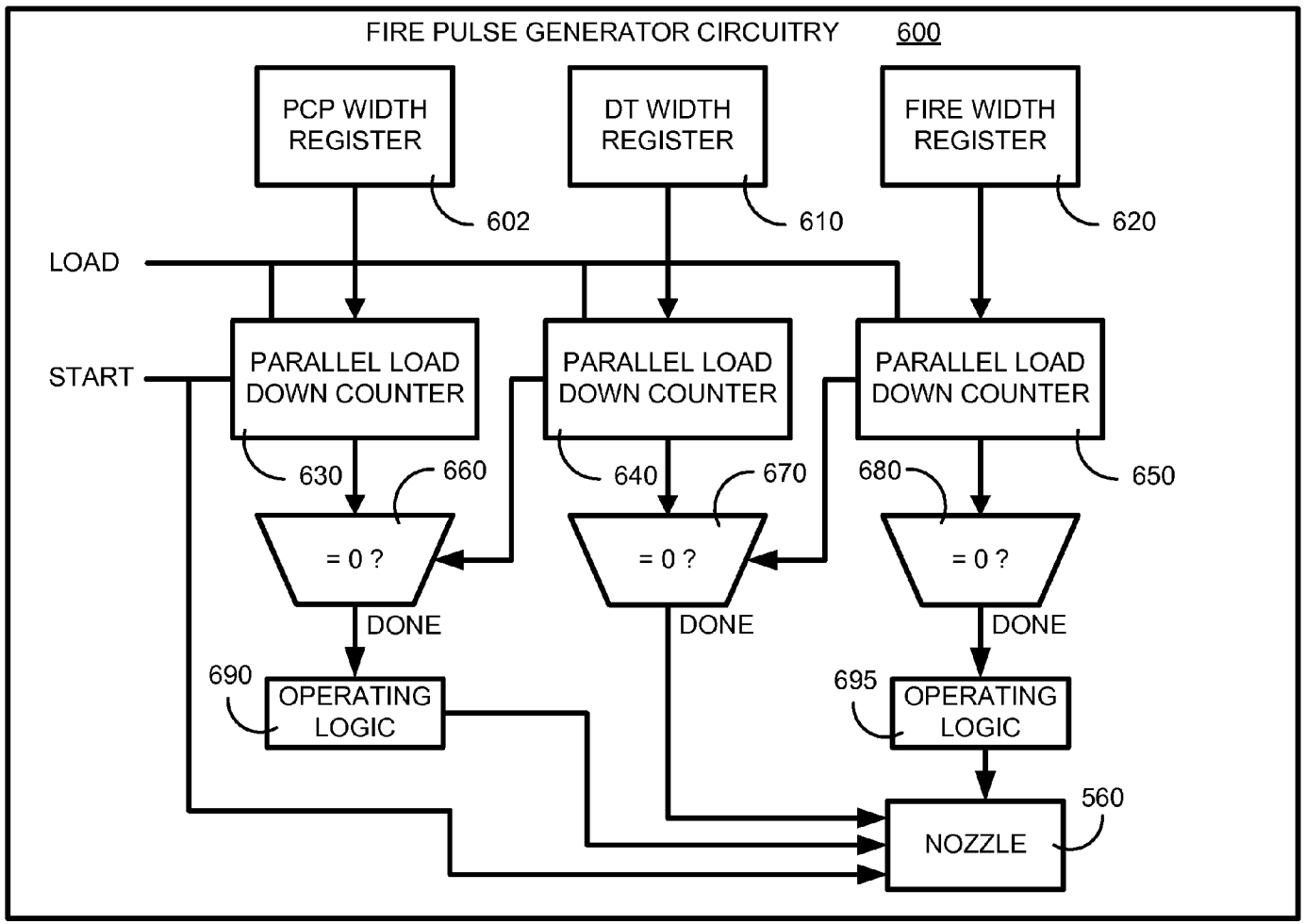
FIG. 6 is one exemplary circuit block diagram illustrating a portion of an inkjet printhead having fire pulse generator circuitry according to one embodiment of the present invention.

FIG. 6 is one exemplary circuit block diagram illustrating a portion of an inkjet printhead having fire pulse generator circuitry according to one embodiment of the present invention. Referring to FIG. 5 along with FIG. 6, in one exemplary embodiment, fire pulse generator circuitry 600 includes the precursor end register 520 as a precursor pulse (PCP) width register 602 for creating the precursor pulse. Also, the dead time register 530 is a dead time (DT) width register 610 for creating the pause between the precursor pulse and the fire pulse, and the fire end register 540 is a fire width register 620 for creating the fire pulse. In one embodiment, the on-chip fire pulse generator circuitry 600 includes a counter for each respective width register, such as parallel load down counters 630, 640 and 650 for counting periods of time.

In addition. comparators 660, 670 and 680 are coupled to respective counters 630, 640 and 650 and determine the count for each respective counter. When the count from counter 630 reaches zero, the precursor pulse from PCP width register 602 is sent to operating logic 690 and when the count from counters 640 and 650 reach zero, the pause from DT width register 610 and the fire pulse from fire width register 620 is sent to operating logic 695 for sending the respective pulses or pause to the nozzle 560.

In one embodiment, internal pulse generation circuits generate the precursor and firing pulses, which are routed to the appropriate nozzles. Alternatively, separate internal pulse generation circuits can be used to generate the precursor and firing pulses, respectively. For example, in one embodiment, one fire pulse generator can be used for the entire printhead. In another embodiment, two or more pulse generators can be used to support the various pulses and different drop weight/ink types. In one embodiment, the precursor and firing pulse widths are programmed dynamically and in real-time with double-buffering. This prevents any reprogramming from corrupting current printing and for enabling efficient printing.

In another embodiment for smaller fire generator circuitry, a single counter and a single register can be used. In this case, the single counter represents times at which the pulses toggle from a current state to another state or an opposite state. In another embodiment, cascading counters are used and the registers represent actual pulse widths versus transition times. In this case, internal fire pulse generators can save connectivity (additional fire pads) if more than one fire pulse width is needed. In addition, a more complex pulse can be generated even when the external controller cannot provide that option. Last, since only a start firing signal is used, other external methods could be employed to initiate firing, thereby completely eliminating the external fire pad altogether.

In another embodiment, the precursor pulses and the firing pulses share the same wiring when sending the respective pulses to the nozzles. In another embodiment, the precursor pulses are sent to the nozzles via precursor pulse wiring and the firing pulses are sent to the nozzles via separate and different firing pulse wiring. The separate wiring allows more control of timing between the precursor pulses and the firing pulses, which helps control and optimize the power distribution in the printhead. In another embodiment, an externally supplied fire signal can represent the precursor pulse width, where the falling edge of the pulse initiates a dead time counter and a fire time counter (time between pulses that apply to a single nozzle firing event).

In one embodiment, the on-chip fire pulse generator 125 completely eliminates the need for external fire pulses for streamlining data input and output to the on-chip fire pulse generator 125. In one embodiment, depending upon the specific implementation and number of replicas of the circuit on the printhead die, several different fire pulse streams can be sent to different areas of the module manager IC 124 driven by the data input without the need for multiple fire pads.

The foregoing has described the principles, embodiments and modes of operation of the present invention. However, the invention should not be construed as being limited to the particular embodiments discussed. The above described embodiments should be regarded as illustrative rather than restrictive, and it should be appreciated that variations may be made in those embodiments by workers skilled in the art without departing from the scope of the present invention as defined by the following claims.

What is claimed is:

1. A method of operating a printhead assembly of an inkjet printer comprising:

initiating at least one precursor pulse;

sending the at least one precursor pulse to a first nozzle;

removing the at least one precursor pulse from the first nozzle for a predetermined period of time to create a pause;

initiating at least one firing pulse after the pause; and sending the at least one firing pulse to the first nozzle for ejecting an ink drop;

wherein the at least one precursor pulse and the at least one firing pulse share the same wiring for sending the respective pulses to the first nozzle.

2. The method of claim 1, wherein removing the at least one precursor pulse includes initiating a dead time register that creates the pause.

3. A method of operating a printhead assembly of an inkjet printer comprising:

initiating at least one precursor pulse;

sending the at least one precursor pulse to a first nozzle;

removing the at least one precursor pulse from the first nozzle for a predetermined period of time to create a pause;

initiating at least one firing pulse after the pause; and sending the at least one firing pulse to the first nozzle for ejecting an ink drop;

wherein the at least one firing precursor pulse is sent to the first nozzle via precursor pulse wiring and the at least one firing pulse is sent to the first nozzle via firing pulse wiring separate and different from the precursor pulse wiring.

4. The method of claim 3, wherein removing the at least one precursor pulse includes initiating a dead time register that creates the pause.

5. A printing system comprising:

a print head including at least one nozzle and an integrated processor;

a precursor end register coupled to the integrated processor and configured to initiate at least one precursor pulse;

a dead time end register coupled to the integrated processor and configured to initiate at least one predetermined time period pause;

a fire end register coupled to the integrated processor and configured to initiate at least one fire pulse; and a controller coupled to the integrated processor and configured to send the at least one precursor pulse to the at least one nozzle, remove the at least one precursor pulse from the at least one nozzle for the predetermined pause, initiate at least one firing pulse after the pause, and send the at least one firing pulse to the at least one nozzle for ejecting an ink drop.

6. The printing system of claim 5, wherein the precursor, dead time and fire end registers are integrated in an on-chip fire pulse generator.

7. The printing system of claim 5, further comprising a clock with a time counter configured to send timing signals to the controller.

* * * * *